US007792461B2

(12) United States Patent
Seike et al.

(10) Patent No.: US 7,792,461 B2
(45) Date of Patent: Sep. 7, 2010

(54) UNIT DRAWING MECHANISM AND IMAGE RECORDER

(75) Inventors: Toshihiko Seike, Nara (JP); Junya Masuda, Nara (JP); Kouji Wakamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 88 days.

(21) Appl. No.: 12/021,376

(22) Filed: Jan. 29, 2008

(65) Prior Publication Data

US 2008/0260419 A1 Oct. 23, 2008

(30) Foreign Application Priority Data

Feb. 1, 2007 (JP) ..... 2007-023341

(51) Int. Cl.
*G03G 15/00* (2006.01)

(52) U.S. Cl. ..... 399/124

(58) Field of Classification Search ..... 399/124, 399/107

See application file for complete search history.

(56) References Cited

U.S. PATENT DOCUMENTS 5,797,068 A 8/1998 Otsuki et al.
7,162,182 B2 * 1/2007 Tonges et al. ..... 399/110
7,272,343 B2 * 9/2007 Takahashi et al. ..... 399/124
7,418,220 B2 * 8/2008 Shiraishi et al. ..... 399/110

FOREIGN PATENT DOCUMENTS

| | | |
|---|---|---|
| JP | 09-134050 | 5/1997 |
| JP | 2005-195714 | 7/2005 |
| JP | 2006-145892 | 6/2006 |
| JP | 2007-052276 | 3/2007 |

* cited by examiner

*Primary Examiner*—Quana M Grainger
(74) *Attorney, Agent, or Firm*—Renner, Otto, Boisselle & Sklar, LLP

(57) ABSTRACT

A unit drawing mechanism according to the present invention includes a drawing unit, a lever, a fixture, a preventer, a linkage, and a lever holder. The drawing unit can move along a movement path between a retracted position in an apparatus and an exposed position outside the apparatus. The lever is supported pivotably on the front side of the drawing unit. The fixture locks the drawing unit in the retracted position. The preventer prevents the drawing unit from moving from the exposed position. The linkage links the lever to the fixture and the preventer. The lever holder holds the lever in a first angular position, a second angular position, and a third angular position when the drawing unit is locked by the fixture, positioned on the movement path, and prevented by the preventer from moving from the exposed position, respectively.

8 Claims, 13 Drawing Sheets

UNIT DRAWING MECHANISM AND IMAGE RECORDER

CROSS REFERENCE

This Nonprovisional application claims priority under 35 U.S.C. §119(a) on Patent Application No. 2007-023341 filed in Japan on Feb. 1, 2007, the entire contents of which are hereby incorporated by reference.

BACKGROUND OF THE INVENTION

The present invention relates to a unit drawing mechanism for drawing one or more units out of an apparatus. The invention also relates to an image recorder that records an image on a sheet of paper being fed along a paper feed path, and that is fitted with a unit drawing mechanism for drawing one or more units out of the recorder.

An electrophotographic or another image recorder includes a paper feed station, a record station, and a delivery station. The record station records an image on a sheet of paper fed from the feed station and then delivers the sheet to the delivery station. For this purpose, the recorder has a paper feed path leading from the feed station through the record station to the delivery station. While a sheet of paper is fed along the feed path, a paper jam may occur. In the record station in particular, because the transfer device, the fixing device, etc. perform many kinds of processing on a sheet of paper, such as transferring a developer image to the sheet and fixing it on the sheet, the sheet warps or otherwise deforms. This reduces the feedability of the sheet and makes a paper jam liable to occur in the recorder.

Still another image recorder has a paper feed path including a reverse feed passage and records images on both sides of a sheet of paper by turning over the sheet at this passage. The inclusion of the reverse feed passage results in the paper feed path having branch points and junction points, where sheets of paper turn in other directions, so that paper jams are liable to occur there.

If a paper jam occurs on the paper feed path of an image recorder, it is necessary to stop feeding sheets of paper along the whole path and suspend image formation until all the sheets on the path are removed. For example, JP-H9-134050A discloses a conventional image recorder including a record station with walls that can be opened. The record station can be drawn out of the recorder to the front side of the recorder so that sheets of paper can be removed easily from the unit.

A proposed unit drawing mechanism includes a first drawing unit and a second drawing unit. The first drawing unit can be drawn out of an apparatus to the front side of the apparatus. The second drawing unit can be drawn from the first drawing unit to one side of the apparatus. The first drawing unit has a first feed passage as a portion of a paper feed path. The second drawing unit has a second feed passage as another portion of the feed path.

By drawing the second drawing unit from the first drawing unit, it is possible to separate the second feed passage from the first feed passage so as to expose the two passages over a wide range.

The two drawing units are free to be drawn and retracted. The second drawing unit may be drawn from the first drawing unit not drawn completely from the apparatus. The first drawing unit may be retracted into the apparatus, without the second drawing unit retracted completely into the first drawing unit. In these cases, the second drawing unit may interfere with the apparatus, so that the apparatus may malfunction or break.

A unit drawing mechanism proposed by the applicant includes a first drawing unit and a second drawing unit. The first drawing unit can be drawn out of an apparatus. The second drawing unit can be drawn from the first drawing unit. If the second drawing unit is in a situation where it may interfere with the apparatus, the two drawing units are kept from moving. This prevents the apparatus from malfunctioning or breaking.

Each of these drawing units is locked in a position automatically when it reaches the position while it is drawn or retracted. As a result, an operator clearing up a paper jam from the apparatus cannot know accurately whether the drawing units are locked. Accordingly, even if the drawing units are not locked, the operator may determine that one or both of them are locked. This may accidentally hurt the operator's fingers.

There may be a case where the operator is removing a sheet of paper from the paper feed path in this apparatus, without the first drawing unit locked. In this case, the weight of the two drawing units may move the first drawing unit into the apparatus, so that the operator's fingers may be caught between this drawing unit and the apparatus.

Such a problem arises not only with a unit drawing mechanism including two drawing units, but also with a unit drawing mechanism including only one drawing unit that can be drawn from an apparatus.

An object of the present invention is to provide a unit drawing mechanism that prevents an operator's injury by indicating the position of its drawing unit between a retracted position and an exposed position by the angular position of the lever supported on the front side of the drawing unit and adapted to be grasped by the operator when he or she draws out and pushes in the drawing unit between the retracted and exposed positions.

Another object of the invention is to provide an image recorder fitted with such a unit drawing mechanism.

SUMMARY OF THE INVENTION

A unit drawing mechanism according to the present invention includes a drawing unit, a lever, a fixture, a preventer, a linkage, and a lever holder. The drawing unit can move along a movement path between a retracted position in an apparatus and an exposed position outside the apparatus. The lever is supported pivotably on the front side of the drawing unit. The fixture locks the drawing unit in the retracted position. The preventer prevents the drawing unit from moving from the exposed position. The linkage links the lever to the fixture and the preventer. The lever holder holds the lever in a first angular position, a second angular position, and a third angular position when the drawing unit is locked by the fixture, positioned on the movement path, and prevented by the preventer from moving from the exposed position, respectively.

An image recorder according to the present invention includes a paper feed station, an image forming station, a delivery station, and a unit drawing mechanism. A paper feed path leads from the paper feed station through the image forming station to the delivery station. The image forming station forms an image on a sheet of paper being fed along the feed path. The unit drawing mechanism includes a drawing unit, through which at least part of the feed path leads through the drawing unit.

DETAILED DESCRIPTION OF THE INVENTION

The best mode of carrying out the present invention will be described below in detail with reference to the accompanying drawings.

Figure 1:
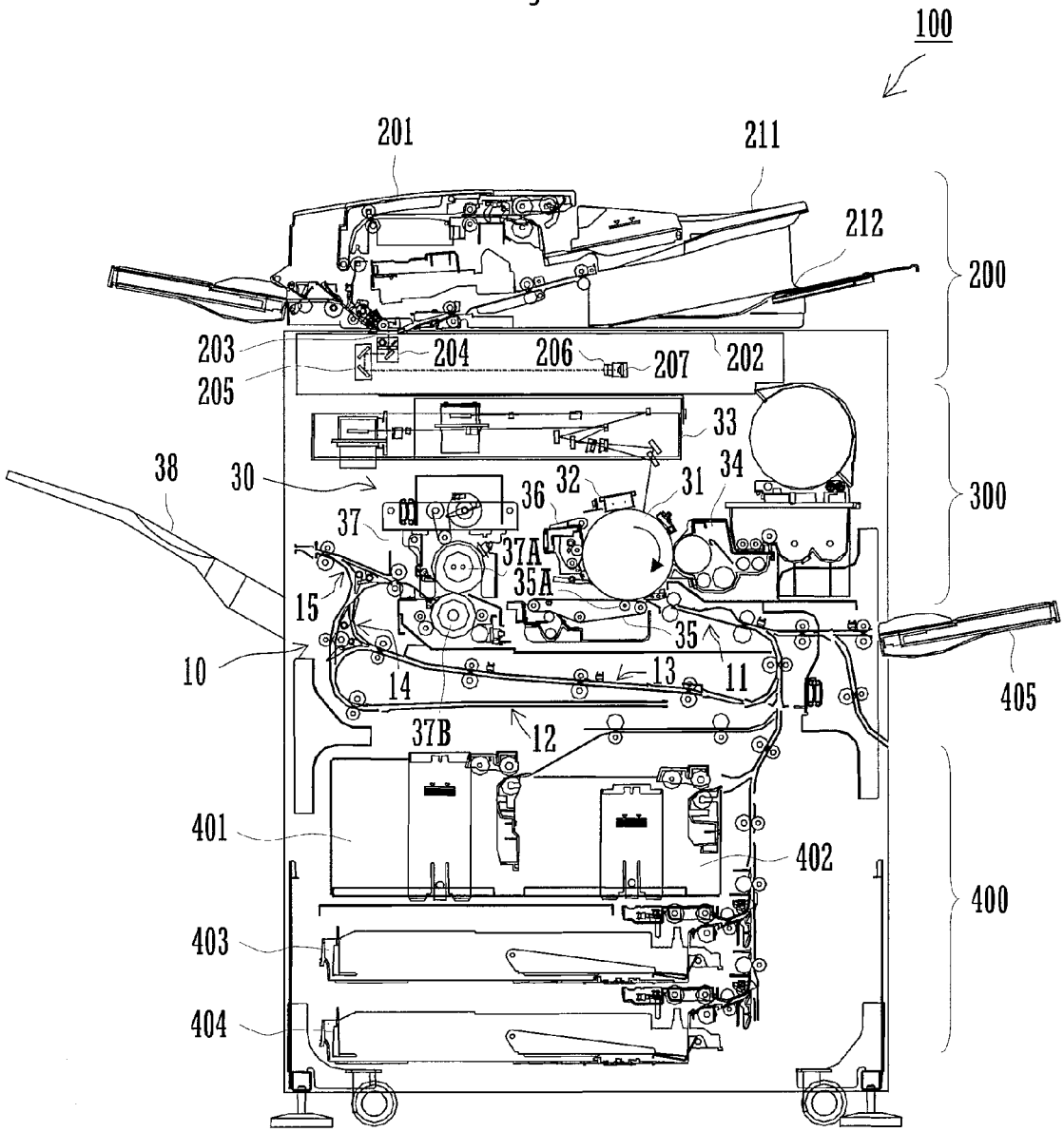
FIG. 1 is a schematic sectional front view of an image recorder embodying the present invention.

FIG. 1 schematically shows an image recorder 100 embodying the present invention. The recorder 100 includes an image reading unit 200, an image forming unit 300, and a paper feed unit 400.

The image reading unit 200 includes an automatic document feeder 201, a first document platform 202, a second document platform 203, a first mirror base 204, a second mirror base 205, a lens 206, and a charge coupled device (CCD) 207.

The document feeder 201 feeds documents one after one from a document tray 211 via the second document platform 203 to an outlet tray 212. The rear edge of the document feeder 201 is so supported that the feeder can pivotably cover the upper side of the first document platform 202. By raising the front edge of the document feeder 201 so as to expose the upper side of the first document platform 202, it is possible to place a document manually on this platform.

The document platforms 202 and 203 are a hard glass plate.

The mirror bases 204 and 205 can move horizontally under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed over the second document platform 203 by the document feeder 201 is read with the first mirror base 204 stopping under this platform. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 is read with the mirror bases 204 and 205 moving horizontally under this platform. The light source on the first mirror base 204 moving under the first document platform 202 radiates light to the front side of the document on this platform. The light reflected by this side of the document is then reflected by the first mirror on the first mirror base 204 toward the second mirror base 205.

Whether the document feeder 201 is used or not, the light reflected by the front side of the document is incident on the CCD 207 via the lens 206 by means of the second and third mirrors on the second mirror base 205, with the optical path length kept constant.

The CCD 207 outputs an electric signal based on the quantity of light reflected by the front side of the document. The electric signal is input as image data into the image forming unit 300.

The image forming unit 300 includes a record station 30. The record station 30 includes a photosensitive drum 31, a charging device 32, an exposure device 33, a developing device 34, a transfer belt 35, a cleaner 36, and a fixing device 37.

The photosensitive drum 31 has a photosensitive layer formed on its cylindrical surface and rotates clockwise in FIG. 1. The charging device 32 charges the drum surface uniformly to a preset electric potential. The charging device 32 may be either a non-contact type charging device with a charger or a contact type charging device with a roller or a brush.

The exposure device 33 irradiates the cylindrical surface of the photosensitive drum 31 with light based on the image data. Photoconduction in the photosensitive layer of the drum 31 forms an electrostatic latent image on the irradiated surface of the drum 31. The exposure device 33 scans the drum surface axially of the drum 31 by means of a polygon mirror with a laser beam modulated with the image data. Alternatively, the exposure device 33 might be replaced by an exposure device having an array of ELs, LEDs, or other light emitting devices.

The developing device 34 supplies the cylindrical surface of the photosensitive drum 31 with toner so as to convert the electrostatic latent image into a toner image, which is visible.

The transfer belt 35 runs in a loop over rollers under the photosensitive drum 31 and has an electric resistance between about $1\times10^{9}$ and $1\times10^{13}$ Ωcm. A transfer roller 35A is supported inside the transfer belt 35 and biased to bring it into compressive contact with the cylindrical surface of the photosensitive drum 31. A transfer voltage is applied to the transfer roller 35A. The toner image carried by the drum 31 is transferred to a sheet of paper passing between the drum and the transfer belt 35.

The cleaner 36 removes the toner remaining on the portion of the drum surface from which the toner image has been transferred to the sheet.

The fixing device 37 includes a heating roller 37A and a pressing roller 37B. The heating roller 37A has a heater fitted in it for heating it to a temperature at which the toner on this roller can melt. The pressing roller 37B is biased into compressive contact with the heating roller 37A under a preset pressure. While the sheet with the toner image on it is passing between these rollers 37A and 37B, the fixing device 37 heats and presses the sheet so as to fix the image fast on the sheet. After the sheet passes through the fixing device 37, it is conveyed to a delivery tray 38, which is fitted on the right (left in FIG. 1) side of the image recorder 100. The delivery tray 38 corresponds to the delivery station of the present invention.

The paper feed unit 400 includes feed cassettes 401-404 and a manual feed tray 405. Each of the feed cassettes 401-404 holds sheets of paper of a size. The manual feed tray 405 supports a sheet of paper of size or quality for less frequent use.

The paper feed unit 400 feeds sheets of paper one after one from one of the feed cassettes 401-404 or the manual feed tray 405. A sheet fed from the feed unit 400 is then fed to the record station 30 through a paper feed path 10, which will be described below.

Figure 2:
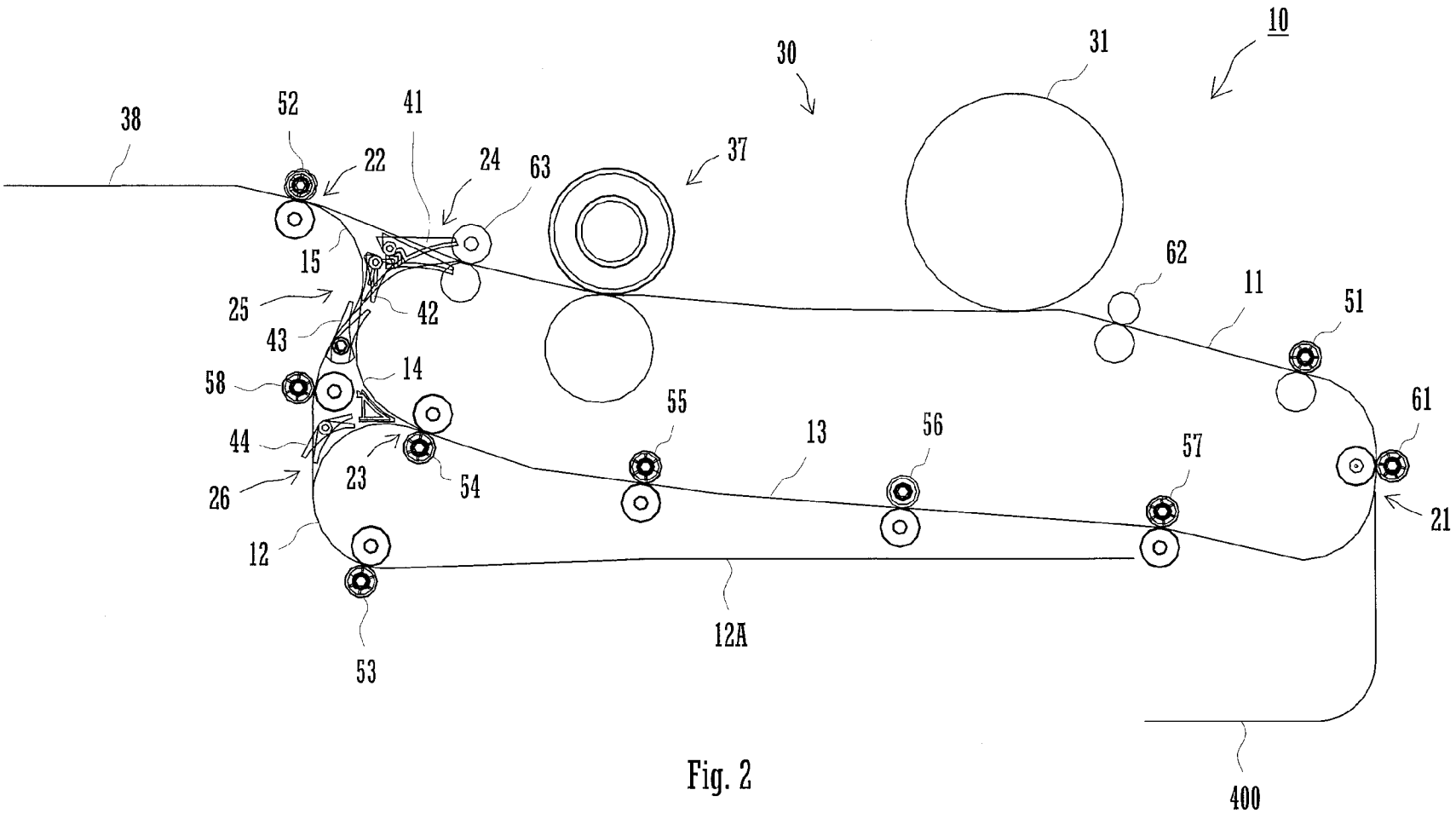
FIG. 2 shows the paper feed path in the image recorder.

FIG. 2 shows the paper feed path 10, which is formed in the image forming unit 300. The feed path 10 includes a first feed passage 11, a second feed passage 12, a third feed passage 13, a fourth feed passage 14, and a fifth feed passage 15.

The first feed passage 11 leads from the paper feed unit 400 through a first junction point 21, the record station 30, a first branch point 24, and a second junction point 22 in that order to the delivery tray 38. Feed rollers 61-63, a registration roller 51, and a delivery roller 52 are supported on the first feed passage 11 and can be rotated by a first motor (not shown).

The transfer belt 35 runs at the substantially horizontal portion of the first feed passage 11, which leads through the record station 30. The transfer belt 35 stably transfers a toner image from the photosensitive drum 31 to a sheet of paper and stably feeds the sheet to which the toner image has been electrostatically attracted before it is fixed.

The second feed passage 12 leads downward from the first branch point 24 on the first feed passage 11, which is positioned between the record station 30 and delivery tray 38, through a second branch point 25 and a third branch point 26 in that order to a first switchback section 12A, where a sheet of paper switchbacks. This switchback section 12A is substantially parallel with the substantially horizontal portion of the first feed passage 11. Reversing rollers 53 and 58 are supported on the second feed passage 12 and coupled to a second motor (not shown) via a first clutch (not shown) so as to be rotated selectively in the normal or opposite direction.

The third feed passage 13 leads from the third branch point 26 through a third junction point 23 to the first junction point 21 on the first feed passage 11, which is positioned between the paper feed unit 400 and record station 30. Feed rollers 54-57 are supported on the third feed passage 13 and coupled to a third motor (not shown) via a second clutch (not shown) so as to be rotated selectively in the normal or opposite direction.

The fourth feed passage 14 connects the second branch point 25 and third junction point 23. The fifth feed passage 15 connects the second branch point 25 and second junction point 22.

The first switchback section 12A of the second feed passage 12 extends under and substantially in parallel with the substantially horizontal portion of the first feed passage 11. The third feed passage 13 is positioned between this portion of the first feed passage 11 and this switchback section 12A.

Figure 3:
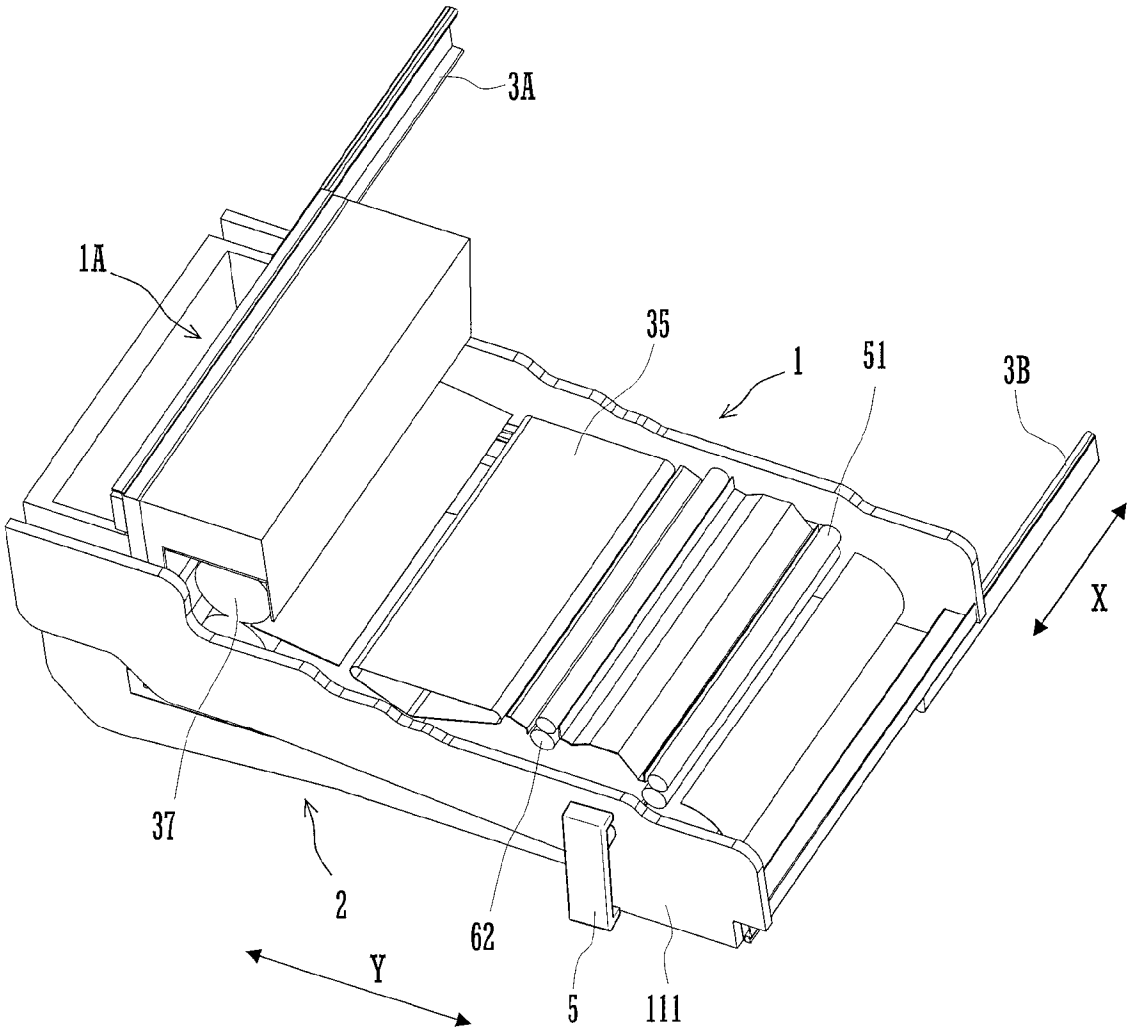
FIG. 3 is a perspective view of the unit drawing mechanism of the image recorder, showing its first and second drawing units having been drawn out of the recorder to the front side of the recorder.
Figure 4:
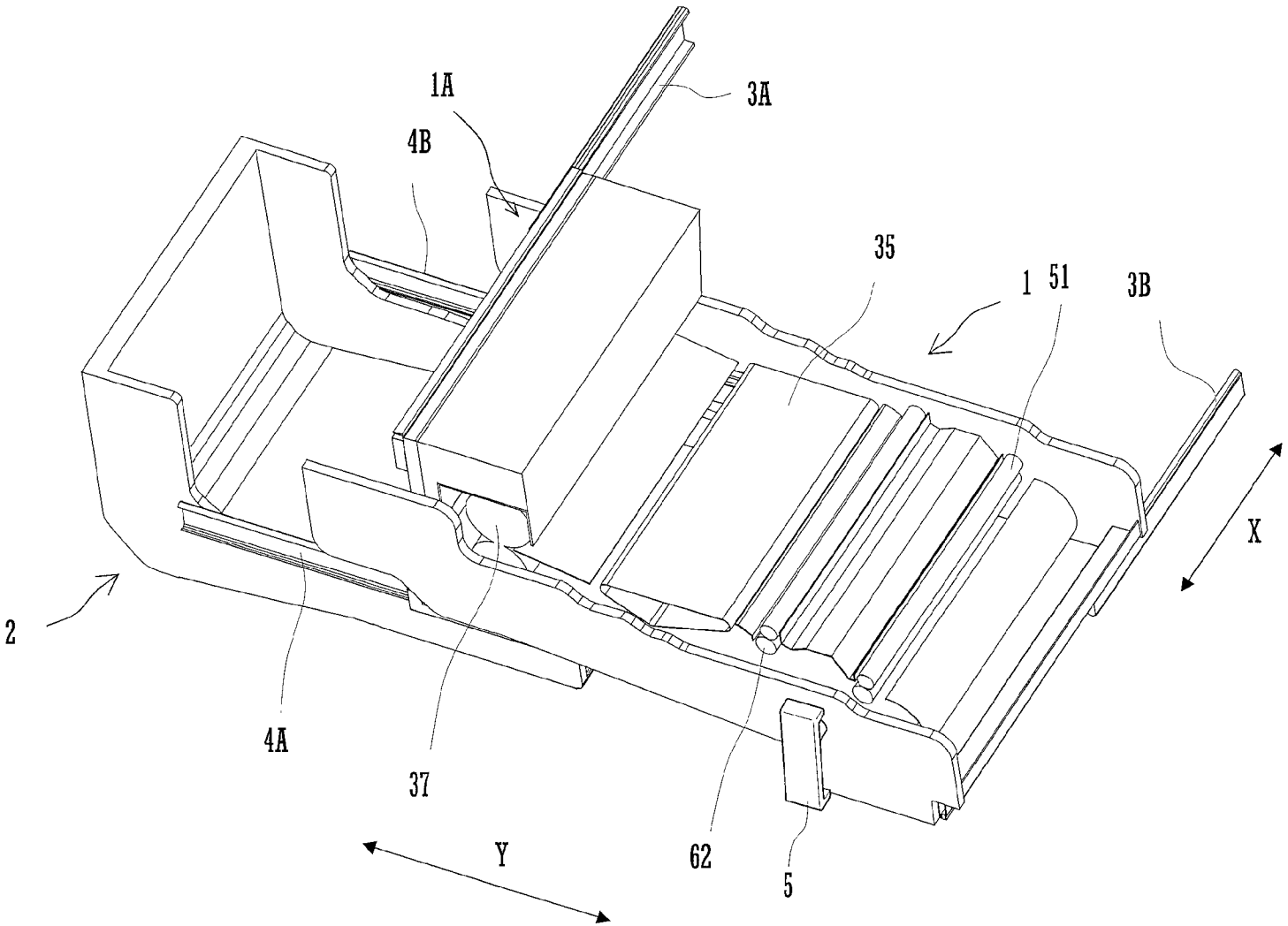
FIG. 4 is another perspective view of the unit drawing mechanism, showing the second drawing unit having been drawn from the first drawing unit to the right (left in FIG. 4) side of the image recorder.

The image recorder 100 is fitted with a unit drawing mechanism as shown in FIGS. 3 and 4. The unit drawing mechanism includes a first drawing unit 1 and a second drawing unit 2. FIG. 3 shows the drawing units 1 and 2 as drawn out of the recorder 100 to its front side. FIG. 4 shows the second drawing unit 2 as drawn from the first drawing unit 1 to the right (left in FIG. 4) side of the recorder 100.

The first drawing unit 1 carries the transfer belt 35, transfer roller 35A, and fixing unit 37. The frame of the image recorder 100 supports the first drawing unit 1 by means of slide rails 3A and 3B extending horizontally along the X-axis, which corresponds to the first axis in the present invention. The first drawing unit 1 can slide along the X-axis between a first retracted position, where its whole is retracted in the recorder 100, and a first exposed position, where the whole of at least one side 1A of this drawing unit is exposed on the front side of the recorder 100.

The first drawing unit 1 includes a front panel 111, on which an operating lever 5 is supported pivotably. The operating lever 5 corresponds to the lever of the present invention. The lever 5 is grasped when the first drawing unit 1 is moved between the retracted position in the image recorder 100 and the exposed position outside the recorder. The recorder 100 corresponds to the apparatus of the invention. The lever 5 can pivot between a first angular position and a third angular position through a second angular position as an intermediate position. In the first angular position, the lever 5 is substantially vertical. In the third angular position, which is at about 45 degrees counterclockwise in FIGS. 3 and 4 from the first angular position, the lever 5 is substantially horizontal.

Figure 5:
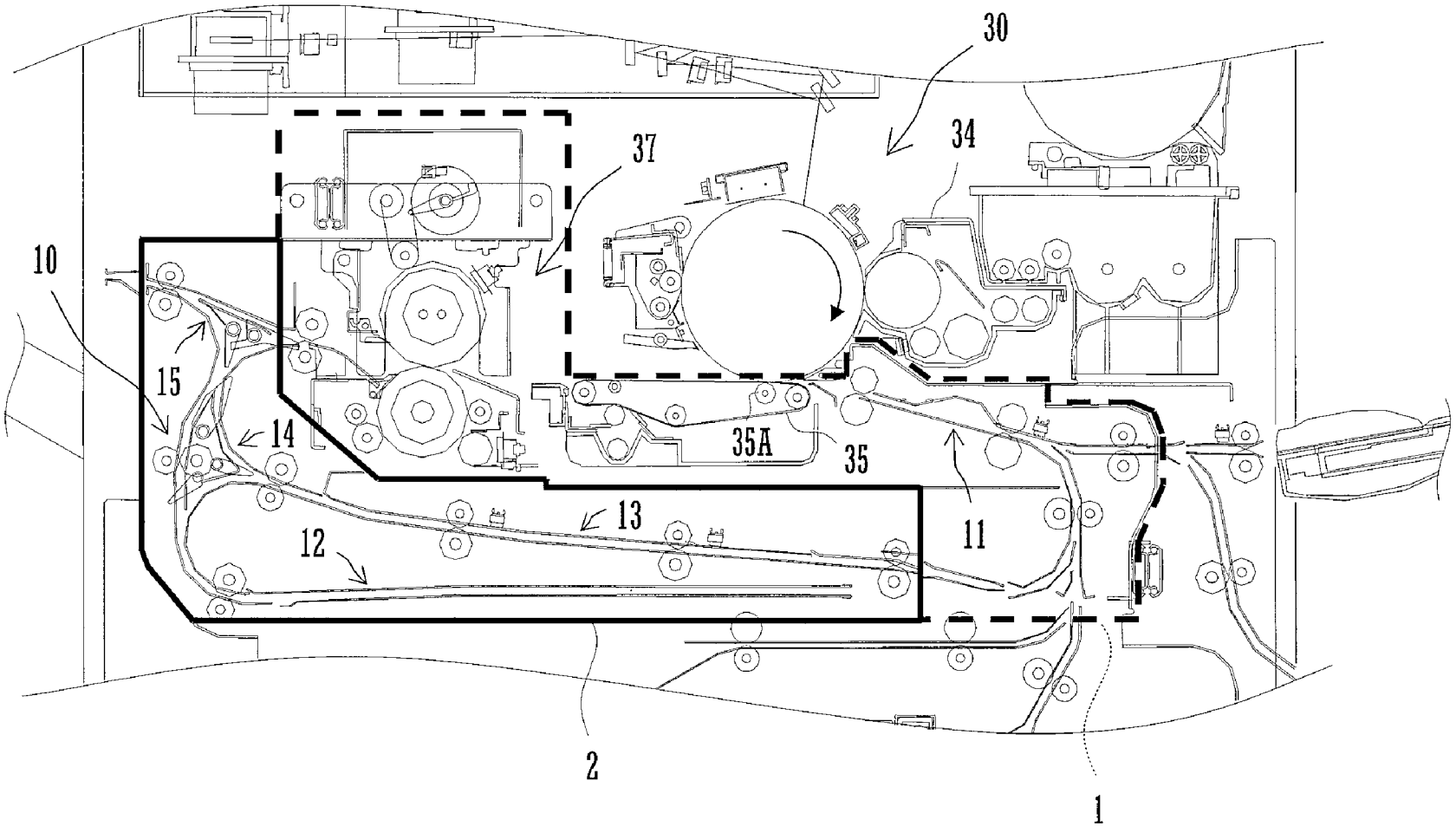
FIG. 5 is an enlarged sectional front view of part of the image recorder, showing the paper feed paths of the two drawing units.

As shown in FIG. 5, the first drawing unit 1 has a first paper feed path, which consists of the substantially horizontal portion of the first feed passage 11 and a portion of the third feed passage 13. The first paper feed path includes this portion of the first feed passage 11, which leads through the record station 30.

When the first drawing unit 1 is drawn from the first retracted position to the first exposed position, as shown in FIG. 3, the substantially horizontal portion of the first feed passage 11 is exposed. This makes it easy to remove a sheet of paper from this portion of the first feed passage 11 only by drawing out the first drawing unit 1 when a paper feed jam or the like occurs. This also makes it easy to confirm whether a sheet of paper is staying on this passage 11.

The slide rails 3A and 3B are positioned on a diagonal line on a vertical plane (on the Z-axis) perpendicular to the Y-axis, which is horizontal and perpendicular to the X-axis. The rails 3A and 3B may be ball-bearing precision slide rails.

As shown in FIG. 5, the second drawing unit 2 has a second paper feed path, which consists of a portion of the first feed passage 11, the second feed passage 12, a portion of the third feed passage 13, the fourth feed passage 14, and the fifth feed passage 15. The second paper feed path includes the second feed passage 12 and third feed passage 13, which extend under and substantially in parallel with the substantially horizontal portion of the first feed passage 11 in the first paper feed path.

As shown in FIG. 4, the first drawing unit 1 supports the second drawing unit 2 by means of slide rails 4A and 4B extending along the Y-axis. The second drawing unit 2 can slide along the Y-axis between a second retracted position, where its whole is retracted in the first drawing unit 1, and a second exposed position, where the second drawing unit 2 is exposed on the side 1A of the first drawing unit 1. The rails 4A and 4B, also, may be ball-bearing precision slide rails.

Although the image recorder 100 is fitted with two drawing units 1 and 2, the present invention may be embodied by an image recorder with only a first drawing unit 1.

FIGS. 6A-6D show the structure and operation of the slide rail 3A, which extends and is telescopic along the X-axis. The slide rail 3A includes a fixed rail 311, an intermediate rail 312, and a movable rail 313. The fixed rail 311 and intermediate rail 312 are in telescopic engagement with each other. The intermediate rail 312 and movable rail 313 are in telescopic engagement with each other.

The fixed rail 311 is fixed to the frame of the image recorder 100. The intermediate rail 312 can slide along the X-axis in the fixed rail 311 by means of ball bearings (not shown). The movable rail 313 is fixed to the first drawing unit 1 and can slide along this axis in the intermediate rail 312 by means of ball bearings (not shown).

The slide rail 3A also includes a telescopic slide preventer. When the slide rail 3A extends, the slide preventer prevents the sliding of the movable rail 313 out of the intermediate rail 312 until the intermediate rail 312 protrudes to the maximum from the fixed rail 311. When the slide rail 3A contracts, the slide preventer prevents the sliding of the intermediate rail 312 into the fixed rail 311 until the movable rail 313 retracts to the maximum into the intermediate rail 312.

Figure 6A:
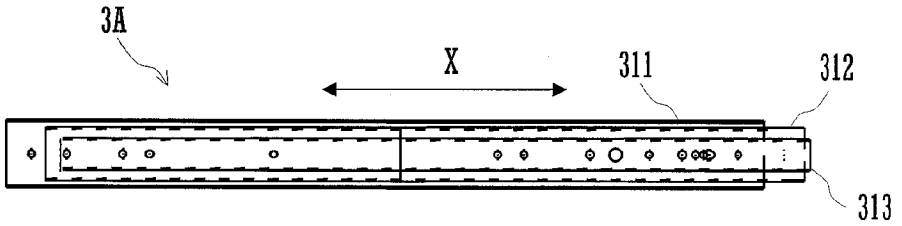
FIGS. 6A-6D are side views of a slide rail of the unit drawing mechanism, showing the structure and operation of the unit.
Figure 6B:
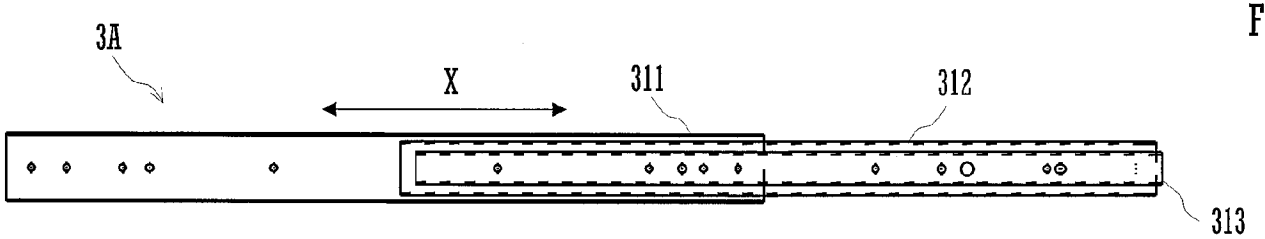

When the slide rail 3A extends from its most contracted state, which is shown in FIG. 6A, the intermediate rail 312 protrudes to the maximum from the fixed rail 311, with the movable rail 313 most retracted in the intermediate rail 312, as shown in FIG. 6B. Subsequently, as shown in FIGS. 6C and 6D, the movable rail 313 protrudes from the intermediate rail 312.

Figure 6C:
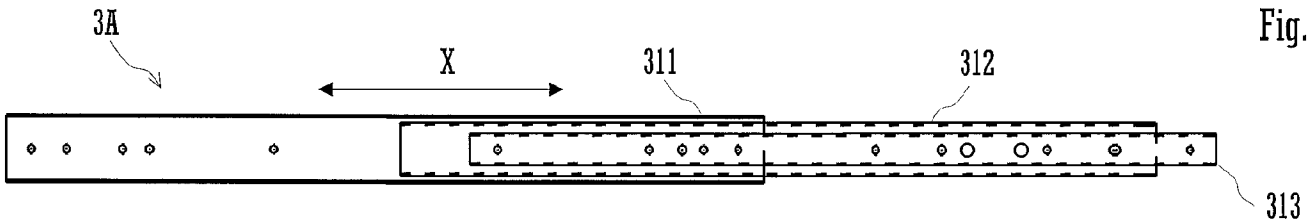
Figure 6D:
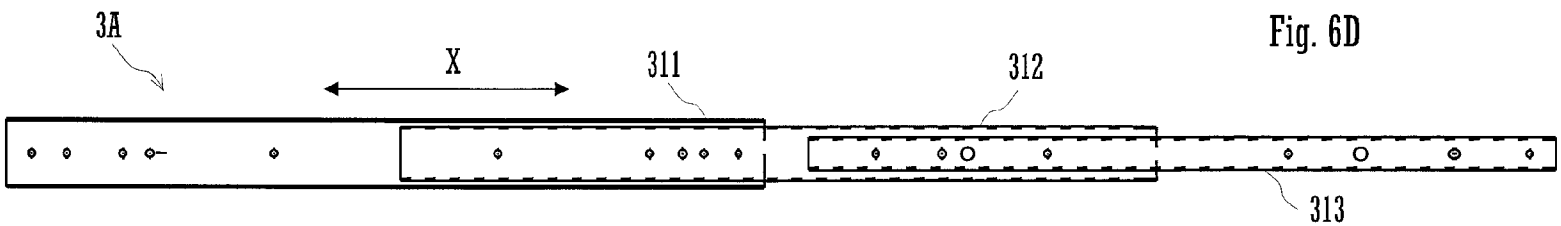

When the slide rail 3A contracts from its most extended state, which is shown in FIG. 6D, the movable rail 313 retracts to the maximum into the intermediate rail 312, with the intermediate rail 312 most extended from the fixed rail 311, as shown in FIG. 6C. Subsequently, as shown in FIGS. 6B and 6A, the intermediate rail 312 retracts into the fixed rail 311.

For example, the intermediate rail 312 may so support a cam that the cam can pivot up and down, and the fixed rail 311 may have a protrusion for engagement with the cam. When the movable rail 313 is protruded from the intermediate rail 312, the weight of the cam keeps it in engagement with the protrusion so that the intermediate rail 312 cannot retract. When the movable rail 313 is most retracted in the intermediate rail 312, the rear end of the movable rail 313 keeps the cam out of engagement with the protrusion so that the intermediate rail 312 can retract.

The movable rail 313 has a protrusion formed on its surface facing the intermediate rail 312. The intermediate rail 312 has a leaf spring fixed to it, which engages elastically with this protrusion when the movable rail 313 is most retracted. When the movable rail 313 is pulled to extend the slide rail 3A, the engagement between the protrusion and the leaf spring makes this rail and the intermediate rail 312 protrude together from the fixed rail 311. After the intermediate rail 312 protrudes to the maximum from the fixed rail 311, the movable rail 313 protrudes from the intermediate rail 312 if the movable rail 313 is pulled with a force greater than the engaging force between the protrusion and the leaf spring.

The slide rails 3A and 3B might be existing slide rails including preventers that act as shown in FIGS. 6A-6D.

When the first drawing unit 1 is in the first retracted position, the slide rail 3A is most contracted as shown in FIG. 6A. When the first drawing unit 1 is drawn from this position to the first exposed position, the movable rail 313 keeps most retracted in the intermediate rail 312 until the intermediate rail 312 protrudes to the maximum from the fixed rail 311. After the intermediate rail 312 protrudes to the maximum, further drawing of the first drawing unit 1 slides the movable rail 313 out of the intermediate rail 312.

When the first drawing unit 1 is in the first exposed position, the slide rail 3A is most extended as shown in FIG. 6D. When the first drawing unit 1 is pushed from this position to the first retracted position, the intermediate rail 312 does not slide until the movable rail 313 retracts to the maximum into the intermediate rail 312. After the movable rail 313 retracts to the maximum, further pushing of the first drawing unit 1 slides the intermediate rail 312 into the fixed rail 311.

Figure 7A:
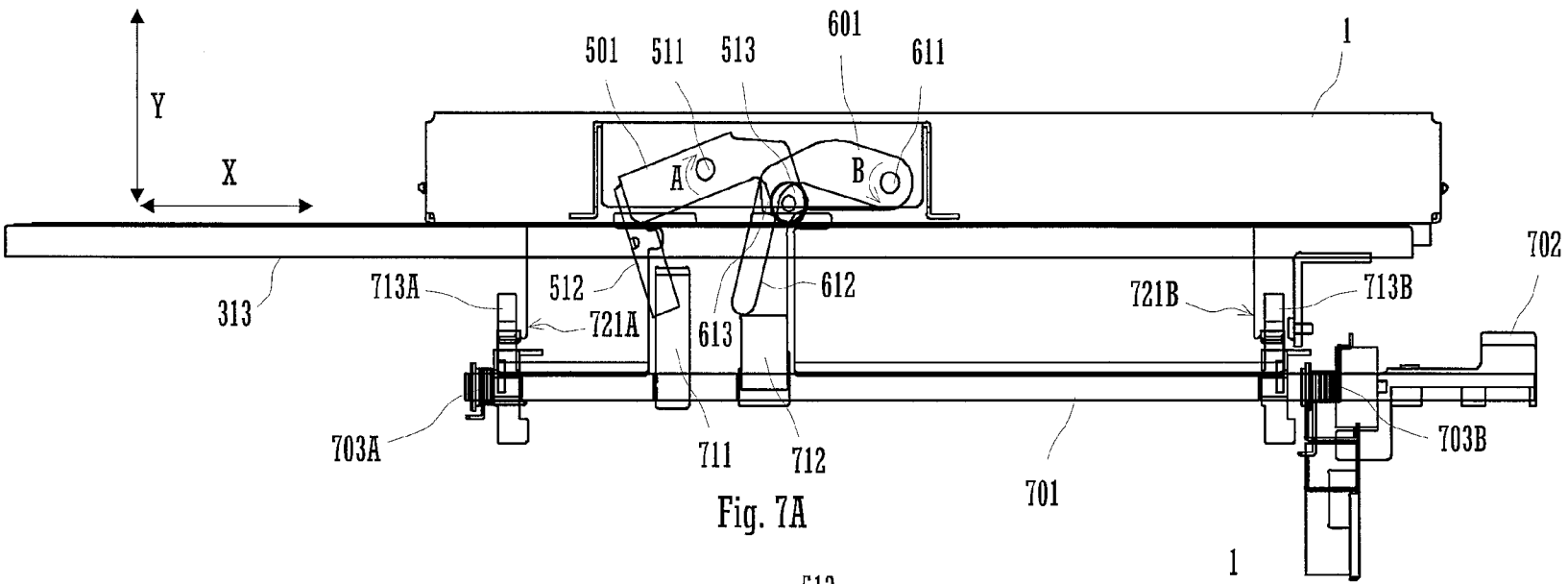
FIGS. 7A and 7B are a plan view and a side view respectively of the first and second locking mechanisms of the image recorder.
Figure 7B:
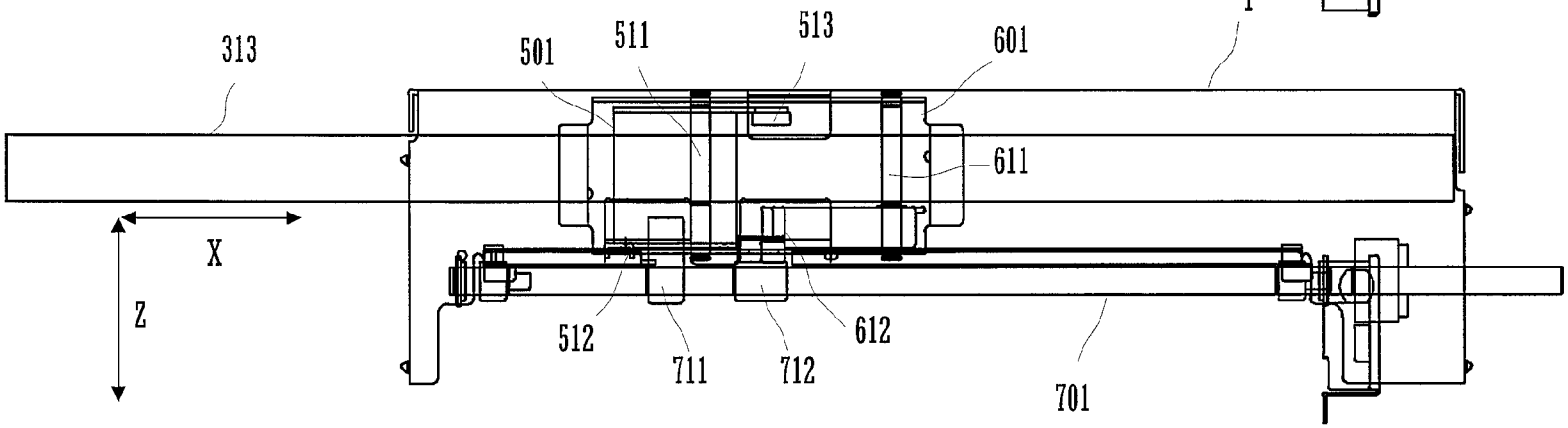

The image recorder 100 is fitted with a first locking mechanism and a second locking mechanism as shown in FIGS. 7A and 7B. A locking shaft 701 is supported by the second drawing unit 2 rotatably on an axis extending along the X-axis. The shaft 701 supports a release arm 711, a release plate 712, and pawls 713A and 713B all fixed to its peripheral surface. A handle 702 is fixed to the front end of the shaft 701.

The first drawing unit 1 includes engaging parts 721A and 721B, with which the pawls 713A and 713B respectively engage when the second drawing unit 2 is in the second retracted position. The locking shaft 701 is fitted with coil springs 703A and 703B, which so bias it around its axis that the pawls 713A and 713B engage upward with the engaging parts 721A and 721B respectively.

The first locking mechanism, which corresponds to the second preventer of the present invention, includes a lever 501. The lever 501 is supported pivotably on a pivot shaft 511 by the first drawing unit 1. This shaft 511 extends vertically along the Z-axis, which is perpendicular to the X-axis and Y-axis. The lever 501 supports a roller 513 above the movable rail 313 and includes an extension 512, which is positioned below this rail 313. The lever extension 512 engages downward with the release arm 711 while the first drawing unit 1 is out of the first exposed position. The lever 501 is biased clockwise (in direction A) in FIG. 7A by a spring (not shown).

The second locking mechanism includes a stopper 601, which is supported pivotably on a pivot shaft 611 by the first drawing unit 1. This shaft 611 extends vertically along the Z-axis. The stopper 601 includes a preventer 613 and a contactor 612, which are positioned below the movable rail 313. The contactor 612 is in contact with the release plate 712 while the second drawing unit 2 is in the second retracted position.

The preventer 613 faces the front end of the under part of the intermediate rail 312. The stopper 601 is biased counterclockwise (in direction B) in FIG. 7A by a spring (not shown). When the second drawing unit 2 is drawn out of the second retracted position, bringing the release plate 712 out of contact with the contactor 612, the stopper 601 pivots in the direction B, bringing the preventer 613 into contact with the front end of the under part of the intermediate rail 312.

Figure 8A:
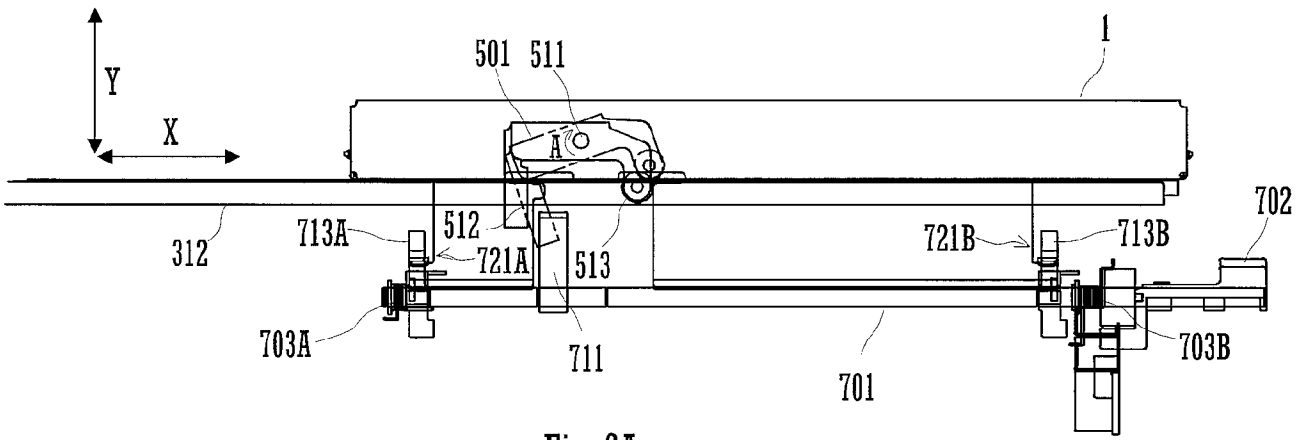
FIGS. 8A and 8B are a plan view and a side view respectively of the first locking mechanism, showing the action of the lever of this mechanism.
Figure 8B:
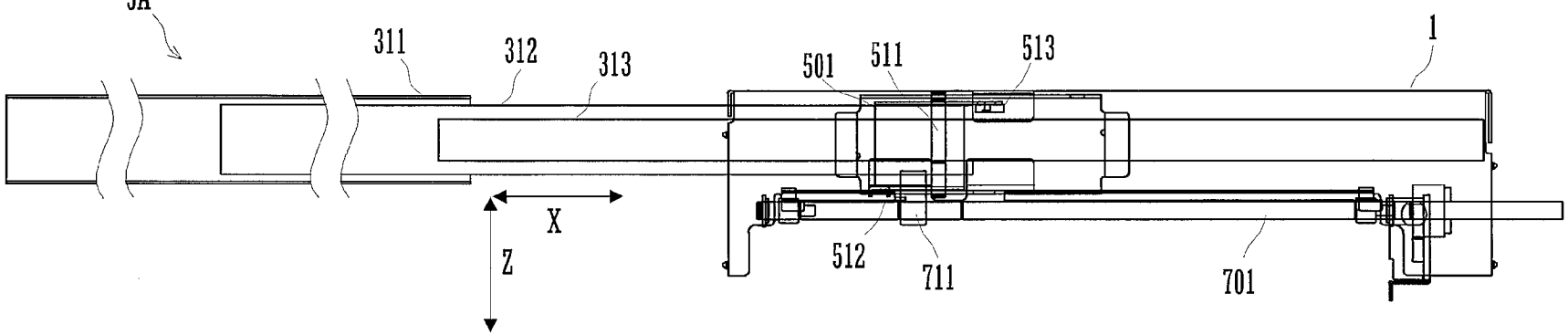

FIGS. 8A and 8B show the action of the lever 501 of the first locking mechanism. When the movable rail 313 is most retracted in the intermediate rail 312, with the first drawing unit 1 out of the first exposed position, the peripheral surface of the roller 513 of the lever 501 is in contact with the adjacent side of the intermediate rail 312 above the movable rail 313.

In the meantime, the lever 501 is positioned as indicated by the two-dot chain lines in FIG. 8A, and the release arm 711 is in contact with the upper side of the lever extension 512. The contact between the release arm 711 and lever extension 512 prevents the locking shaft 701 from rotating to turn the arm 711 and pawls 713A and 713B downward.

While the first drawing unit 1 is out of the first exposed position, the operation of the handle 702 does not make it possible to so turn the locking shaft 701 as to turn the pawls 713A and 713B downward. This keeps the pawls 713A and 713B in engagement with the engaging parts 721A and 721B respectively, thereby preventing the second drawing unit 2 from being drawn along the Y-axis out of the first drawing unit 1.

When the first drawing unit 1 is drawn along the X-axis from the first retracted position toward the first exposed position, the intermediate rail 312 protrudes to the maximum from the fixed rail 311, and subsequently the movable rail 313 protrudes from the intermediate rail 312, with the lever roller 513 rolling on the adjacent side of the intermediate rail 312.

When the first drawing unit 1 reaches the first exposed position, the lever roller 513 has passed the front end of the intermediate rail 312, so that the peripheral surface of this roller 513 is out of contact with the intermediate rail 312. This allows the lever 501 to pivot by the elastic force of the associated spring in the direction A to its position indicated by solid lines in FIG. 8A. In this position, the lever extension 512 is out of contact with the release arm 711 so that the arm can turn downward. This allows the pawls 713A and 713B to turn downward.

While the first drawing unit 1 is in the first exposed position, the operation of the handle 702 makes it possible to so turn the locking shaft 701 as to turn the pawls 713A and 713B downward. This makes it possible to disengage the pawls 713A and 713B from the engaging parts 721A and 721B respectively so that the second drawing unit 2 can be drawn along the Y-axis from the first drawing unit 1.

Thus, the lever 501 keeps the second drawing unit 2 from moving from the second retracted position to the second exposed position while the first drawing unit 1 is out of the first exposed position. As a result, while the first drawing unit 1 is drawn out of the image recorder 100, the second drawing unit 2 is kept reliably in the drawing unit 1. This prevents the interference of the second drawing unit 2 with the recorder 100 so that the recorder can be kept from malfunctioning or breaking.

Figure 9A:
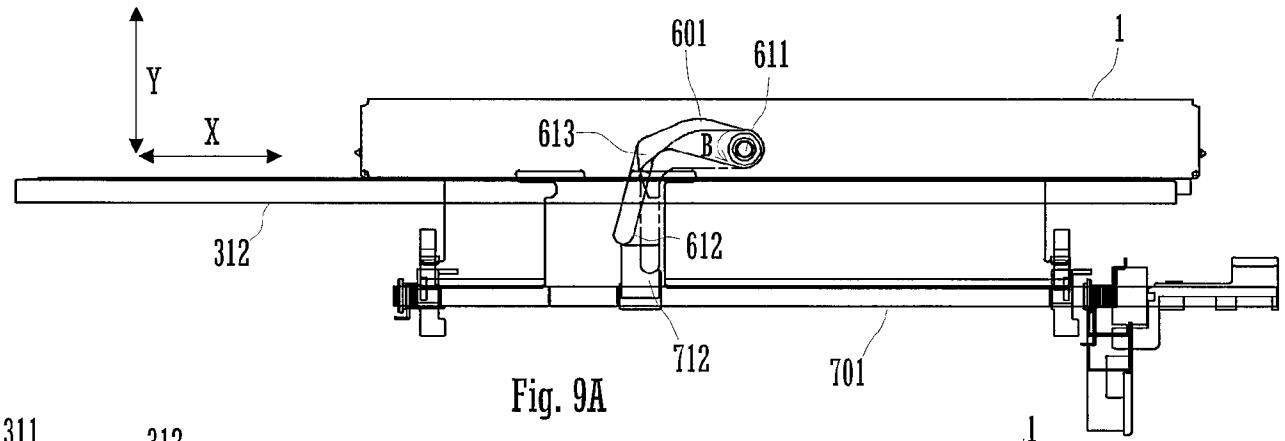
FIGS. 9A and 9B are a plan view and a side view respectively of the second locking mechanism, showing the action of the stopper of this mechanism.
Figure 9B:
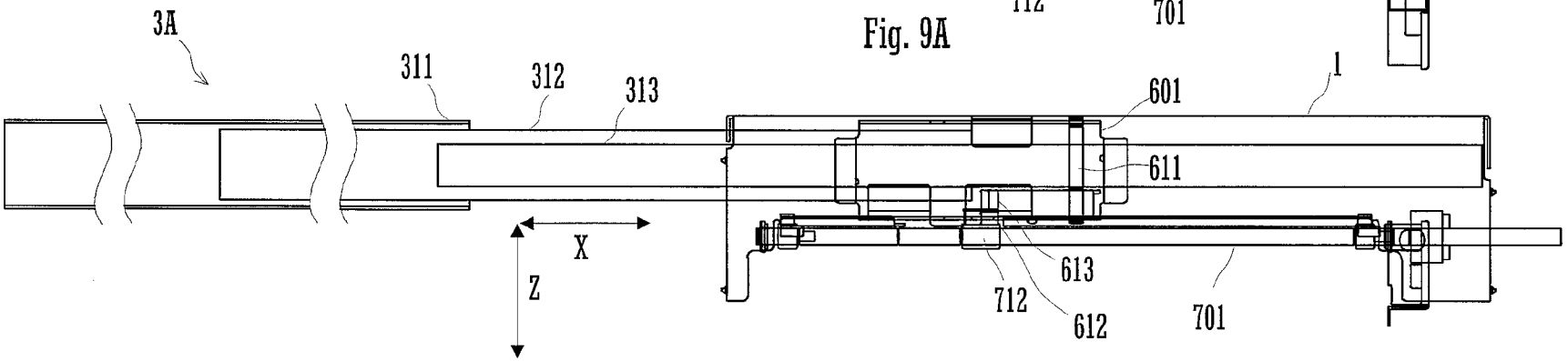

FIGS. 9A and 9B show the action of the stopper 601 of the second locking mechanism. While the second drawing unit 2 is in the second retracted position, the stopper 601 is positioned as indicated by solid lines in FIG. 9A, with its contactor 612 in contact with the release plate 712. In the meantime, the preventer 613 of the stopper 601 is out of contact with the front end of the under part of the intermediate rail 312 so that the first drawing unit 1 can slide along the X-axis. Thus, while the second drawing unit 2 is in the second retracted position, the first drawing unit 1 can slide toward the first retracted position.

While the second drawing unit 2 is drawn along the Y-axis from the second retracted position toward the second exposed position, the locking shaft 701 moves together with this drawing unit away from the slide rail 3A, so that the release plate 712 comes out of contact with the contactor 612 of the stopper 601. This allows the stopper 601 to pivot by the elastic force of the associated spring in the direction B to its position indicated by the two-dot chain lines in FIG. 9A. In this position, the preventer 613 is in contact with the front end of the under part of the intermediate rail 312.

As stated already, the movable rail 313 is fixed to the first drawing unit 1, which supports the stopper 601. The contact of the preventer 613 with the front end of the under part of the intermediate rail 312 prevents the movable rail 313 from retracting into the intermediate rail. While the movable rail 313 is not most retracted in the intermediate rail 312, the intermediate rail is prevented from retracting. This keeps the first drawing unit 1 from moving toward the first retracted position while the second drawing unit 2 is out of the second retracted position.

Thus, the stopper 601 prevents the first drawing unit 1 from moving from the first exposed position to the first retracted position while the second drawing unit 2 is out of the second retracted position. As a result, while the second drawing unit 2 is out of the first drawing unit 1, the first drawing unit is prevented reliably from retracting into the image recorder 100. This prevents the interference of the second drawing unit 2 with the recorder 100 so that the recorder can be kept from malfunctioning or breaking.

As stated already, the first and second locking mechanisms include a lever 501 and a stopper 601 respectively. Alternatively, the first locking mechanism might include another structure that prevents the second drawing unit 2 from moving from the second retracted position to the second exposed position while the first drawing unit 1 is out of the first exposed position. Likewise, the second locking mechanism might include another structure that prevents the first drawing unit 1 from moving from the first exposed position to the first retracted position while the second drawing unit 2 is out of the second retracted position.

Both of the two locking mechanisms might not need to be provided. The provision of at least one of the locking mechanisms could reduce the possibility that the second drawing unit 2 might interfere with the image recorder 100. This could reduce the frequency with which the recorder 100 malfunctions or breaks.

Figure 10A:
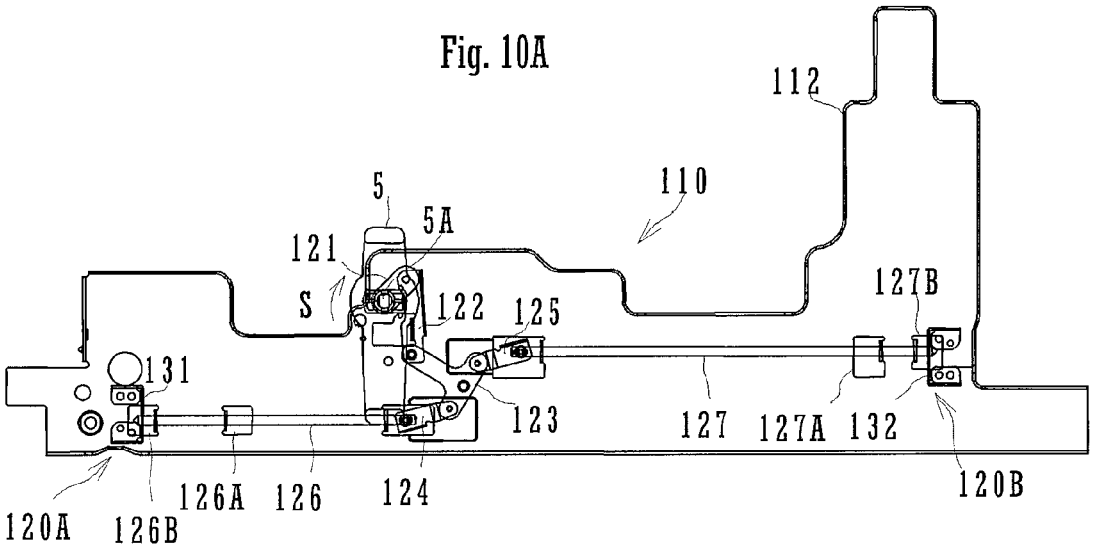
FIGS. 10A-10C are rear views of the linkage and fixtures of the unit drawing mechanism.
Figure 10B:
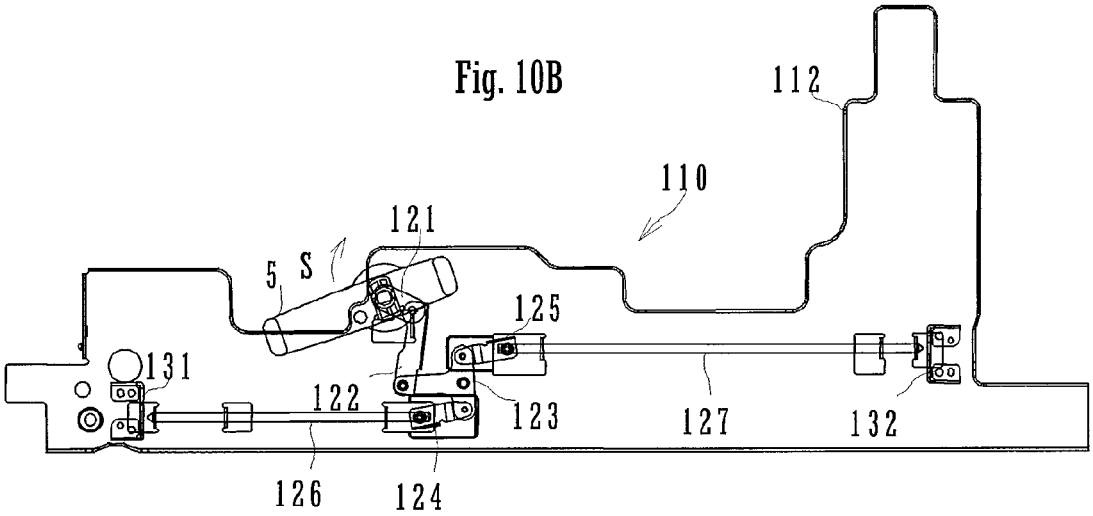
Figure 10C:
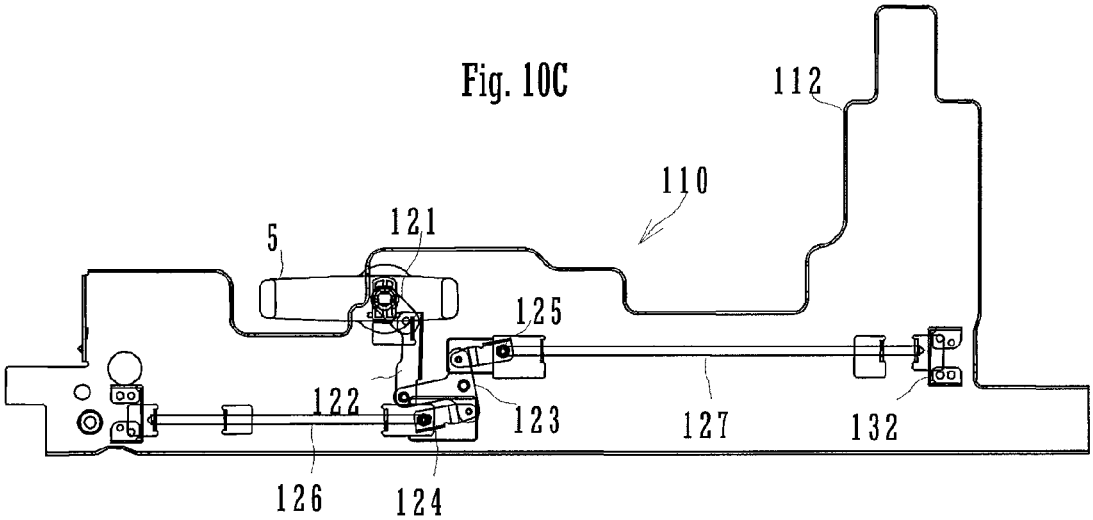

With reference to FIGS. 10A-10C, the unit drawing mechanism includes a linkage 110 and fixtures 120A and 120B. The linkage 110 includes links 121-125, which are positioned on the back side of the first drawing unit 1. The fixtures 120A and 120B include shafts 126 and 127 respectively and fixing plates 131 and 132 respectively, all of which are positioned on the back side of the first drawing unit 1.

One end of the link 121 is fixed to the shaft 5A of the operating lever 5. One end of the link 122 is connected rotatably to the other end of the link 121. The other end of the link 122 is connected rotatably to the substantially T-shaped link 123, to which one end of the link 124 and one end of the link 125 are connected rotatably. The other ends of the links 124 and 125 are connected rotatably to one end of the fixture shaft 126 and one end of the fixture shaft 127 respectively.

The first drawing unit 1 includes a back panel 112, to which supporting plates 126A, 126B, 127A, and 127B are fixed. The fixture shaft 126 extends along the Y-axis through the holes in the supporting plates 126A and 126B and can shift axially relative to the panel 112. The fixture shaft 127 extends along the Y-axis through the holes in the supporting plates 127A and 127B and can shift axially relative to the panel 112.

When the operating lever 5 is turned, turning force is transmitted from the lever shaft 5A through the links 121-125 to the fixture shafts 126 and 127, thereby shifting these shafts along the Y-axis relative to the panel 112.

The fixing plates 131 and 132 are fixed to the frame of the image recorder 100 and face the free ends of the fixture shafts 126 and 127 respectively while the first drawing unit 1 is in the first retracted position. Each of the fixing plates 131 and 132 has a hole formed through it for engagement with the free end of the adjacent fixture shaft 126 or 127.

When the operating lever 5 is in the first angular position, as shown in FIG. 10A, with the first drawing unit 1 in the first retracted position, the free ends of the fixture shaft 126 or 127 are in engagement with the holes of the fixing plates 131 and 132 respectively. This keeps the first drawing unit 1 from moving from the first retracted position.

When the operating lever 5 is turned for about 70 degrees in the direction S from the first angular position to the second angular position, which is shown in FIG. 10B, the free ends of the fixture shaft 126 or 127 disengage from the fixing plates 131 and 132. This allows the first drawing unit 1 to move from the first retracted position.

The operating lever 5 can be turned further in the direction S from the second angular position to the third angular position, which is shown in FIG. 10C. The links 121-125 transmit to the fixtures 120A and 120B the turning force created by the operating lever 5 pivoting only between the first and second angular positions. The links 121-125 do not transmit to the fixture shaft 126 or 127 the turning force created by the operating lever 5 pivoting between the second and third angular positions. When the operating lever 5 is in the third angular position also, the first drawing unit 1 can move.

Figure 11A:
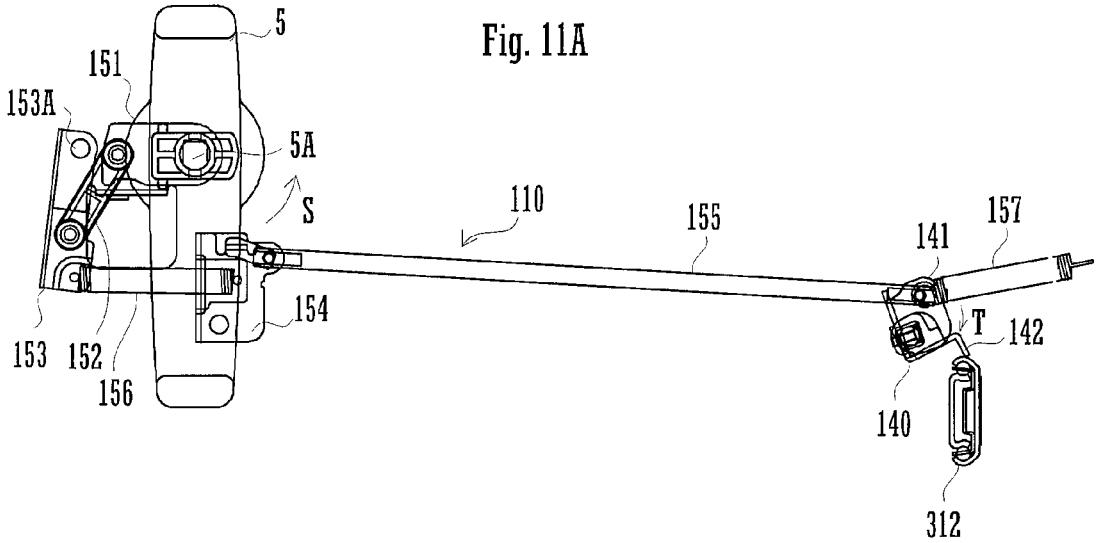
FIGS. 11A-11C are front views of the first preventer of the unit drawing mechanism.
Figure 11B:
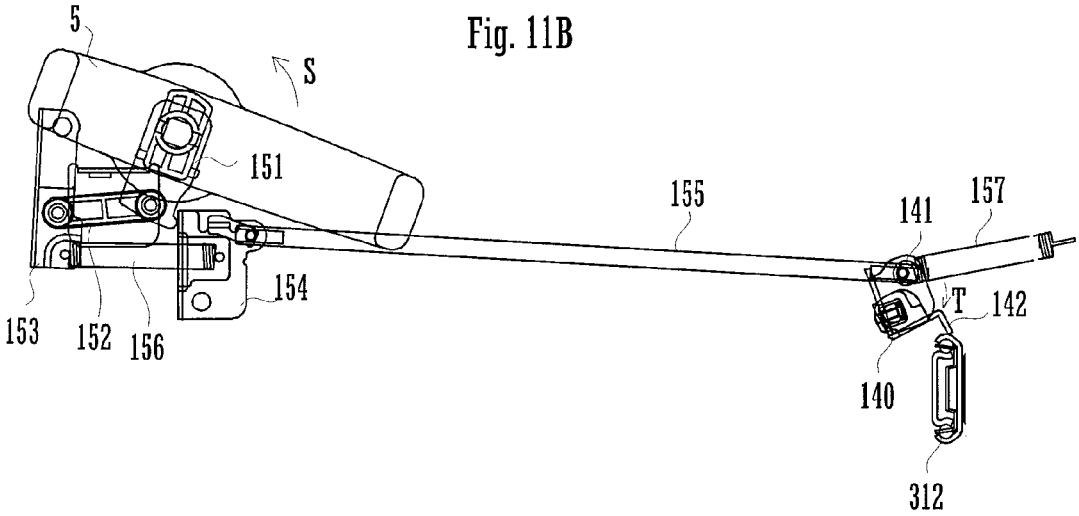
Figure 11C:
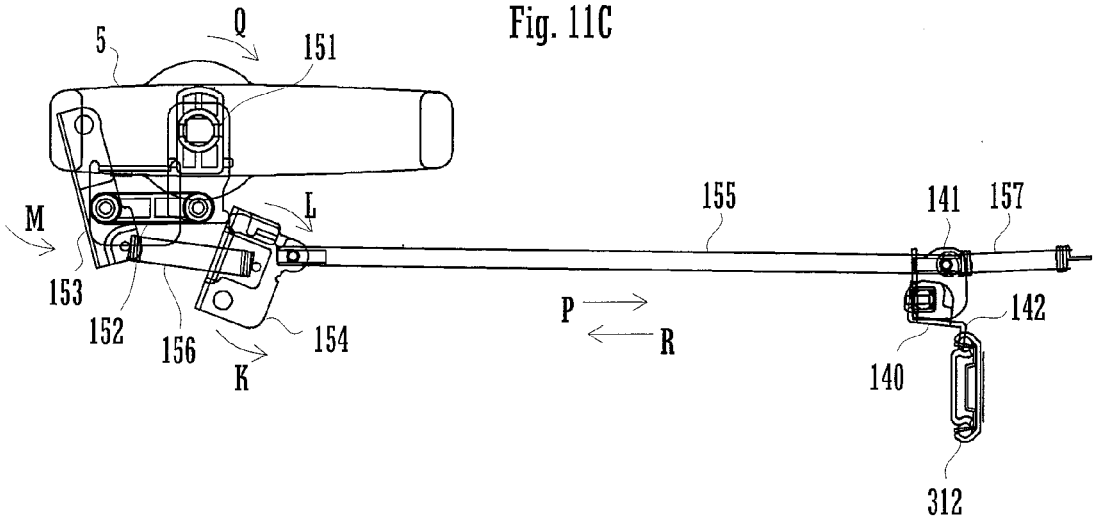

With reference to FIGS. 11A-11C, the unit drawing mechanism includes a first preventer 140. The linkage 110 includes other links 151-154, a shaft 155, and springs 156 and 157, all of which are positioned on the front side of the first drawing unit 1.

One end of the link 151 is fixed to the shaft 5A of the operating lever 5. One end of the link 152 is connected rotatably to the other end of the link 151. The other end of the link 152 is connected rotatably to a middle portion of the link 153, the top of which is supported rotatably by the first drawing unit 1. The spring 156 connects the links 153 and 154. The link 154 is supported pivotably by the first drawing unit 1. One end of the linkage shaft 155 is connected rotatably to the link 154. The spring 157 connects the other end of the linkage shaft 155 and the front panel 111 of the first drawing unit 1.

The first preventer 140 is supported rotatably on an axis (not shown) by the first drawing unit 1 and connected to the end of the linkage shaft 155 that is connected to the spring 157. This preventer 140 includes an extension 142.

While the operating lever 5 is in the first angular position, as shown in FIG. 11A, the preventer extension 142 is in contact with the upper edge of the intermediate rail 312 of the slide rail 3B. Shifting of the links 151 and 152 absorbs the turning force created by the operating lever 5 pivoting from the first angular position to the second angular position, which is shown in FIG. 11B. The absorbed force is not transmitted to the link 153, so that the link 154 and linkage shaft 155 do not shift. Accordingly, when the operating lever 5 is in the second angular position also, the preventer extension 142 keeps in contact with the upper edge of the intermediate rail 312.

While the operating lever 5 is between the first and second angular positions, the linkage spring 156 is neither extended nor compressed and creates no elastic force. In the meantime, the linkage spring 157 creates a tensile force, biasing the linkage shaft 155 in the direction P away from the operating lever 5, and also biasing the first preventer 140 in the direction T.

When the operating lever 5 is in the second angular position, as shown in FIG. 11B, with the first drawing unit 1 still out of the first exposed position, the link 151 is in contact with the link 154. This prevents the link 151 from pivoting with the operating lever 5 in the direction S.

When the first drawing unit 1 is drawn to the first exposed position, the extension of the slide rail 3B brings the preventer extension 142 out of contact with the upper edge of the intermediate rail 312 of this slide rail, as shown in FIG. 11C. This allows the tensile force of the linkage spring 157 to turn the first preventer 140 in the direction T, bringing the preventer extension 142 into contact with front end of the upper part of the intermediate rail 312 of the slide rail 3B.

In the meantime, the tensile force of the linkage spring 157 shifts the linkage shaft 155 in the direction P, turning the link 154 in the direction L. This extends the linkage spring 156, turning the link 153 in the direction M. The turning force of this link 153 is transmitted through the link 152 to the link 151, thereby turning the link 151 with the operating lever 5 and lever shaft 5A in the directions S. This shifts the operating lever 5 from the second angular position to the third angular position.

Figure 12A:
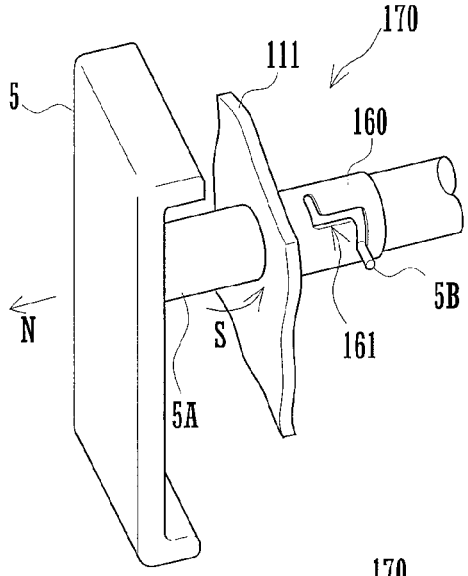
FIGS. 12A-12C are perspective views of the lever holder of the unit drawing mechanism.
Figure 12B:
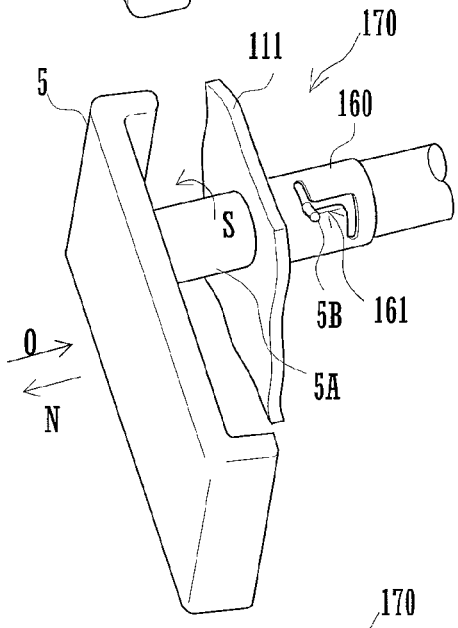
Figure 12C:
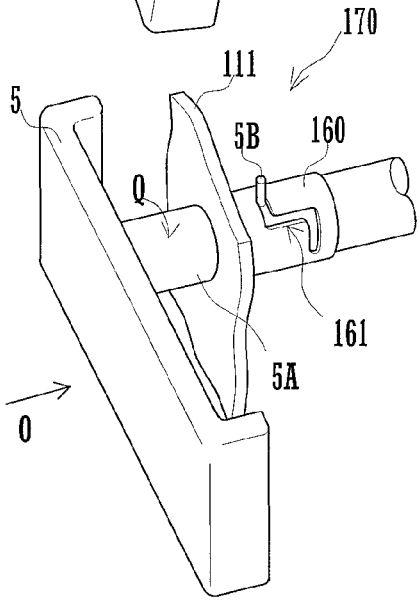

The unit drawing mechanism includes a lever holder 170 as shown in FIGS. 12A-12C. The holder 170 includes a bearing 160, which is fixed to the back side of the front panel 111 of the first drawing unit 1. The lever shaft 5A is supported by the bearing 160 rotatably and axially slidably. The lever shaft 5A extends loosely through the front panel 111, in front of which the operating lever 5 is fixed to the front end of the shaft 5A.

The bearing 160 has a slit 161, which includes a front part, a rear part, and a horizontal part extending between the other parts. The lever shaft 5A has a pin 5B fixed to its peripheral surface. The pin 5B may be fixed to the shaft surface by being screwed into a tapped hole in the lever shaft 5A. The pin 5B is in engagement with the slit 161.

While the first drawing unit 1 is in the first retracted position, the pin 5B is positioned at the bottom of the rear part of the slit 161, as shown in FIG. 12A. In the meantime, the operating lever 5 is in the first angular position, and the first drawing unit 1 is locked in the first retracted position by the fixtures 120A and 120B, as shown in FIG. 10A.

When the operating lever 5 is turned in the direction S from the first angular position, the pin 5B shifts upward along the rear part of the slit 161. The operating lever 5 can be turned in this direction until the pin 5B reaches the horizontal part of the slit 161. When the pin 5B reaches this part of the slit 161, the operating lever 5 reaches the second angular position, which is shown in FIG. 12B. In the meantime, as shown in FIG. 10B, the fixture shafts 126 and 127 disengage from the fixing plates 131 and 132. When the operating lever 5 in the second angular position is pulled in the direction N, the pin 5B shifts forward along the horizontal part of the slit 161. After the pin 5B reaches the front part of the slit 161, as shown in FIG. 12B, further pulling of the operating lever 5 in this direction moves the first drawing unit 1 forward.

With reference to FIG. 11C, when the first drawing unit 1 reaches the first exposed position, the tensile force of the linkage spring 156 turns the operating lever 5 with the lever shaft 5A in the direction S. This shifts the pin 5B along the front part of the slit 161 to the top of this part, with the operating lever 5 pivoting in this direction to the third angular position, which is shown in FIG. 12C. The pin 5B engaging with the front part of the slit 161 is kept from shifting in the directions N and O relative to the lever holder 170. This prevents the first drawing unit 1 in the first exposed position from moving toward the first retracted position even if the operating lever 5 is pushed backward.

The movement of the first drawing unit 1 from the first exposed position to the first retracted position requires that the operating lever 5 be turned in the direction Q from the to third angular position to the second angular position, with the pin 5B shifting along the front part of the slit 161 to the horizontal part of the slit. When the operating lever 5 is turned from the third angular position, which is also shown in FIG. 11C, to the second angular position, which is also shown in FIG. 11B, the link 151 is turned in the direction Q, so that the links 152 and 153 and linkage spring 156 turn the link 154 in the direction K. The turning of this link 154 in this direction shifts the linkage shaft 155 in the direction R, so turning the first preventer 140 as to shift the preventer extension 142 upward out of engagement with the front end of the intermediate rail 312. This makes it possible to move the first drawing unit 1 from the first exposed position to the first retracted position by pushing the operating lever 5 in the direction O (FIG. 12B).

Thus, the operating lever 5 can be held in the first, second, and third angular positions when the first drawing unit 1 is in the first retracted position, between this position and the first exposed position, and in this exposed position, respectively. The operator can accurately know the position of the first drawing unit 1 by visually confirming which of the three angular positions the operating lever 5 is in.

For example, in order to clear up a paper jam from the image recorder 100, the operator draws the first drawing unit 1 from the first retracted position. While the first drawing unit 1 is between this position and the first exposed position, the operating lever 5 is in the second angular position. By visually confirming this lever position, the operator can know that the first drawing unit 1 is free to move along the X-axis and may hurt his or her fingers if they are put in this drawing unit or the recorder 100.

Figure 13:
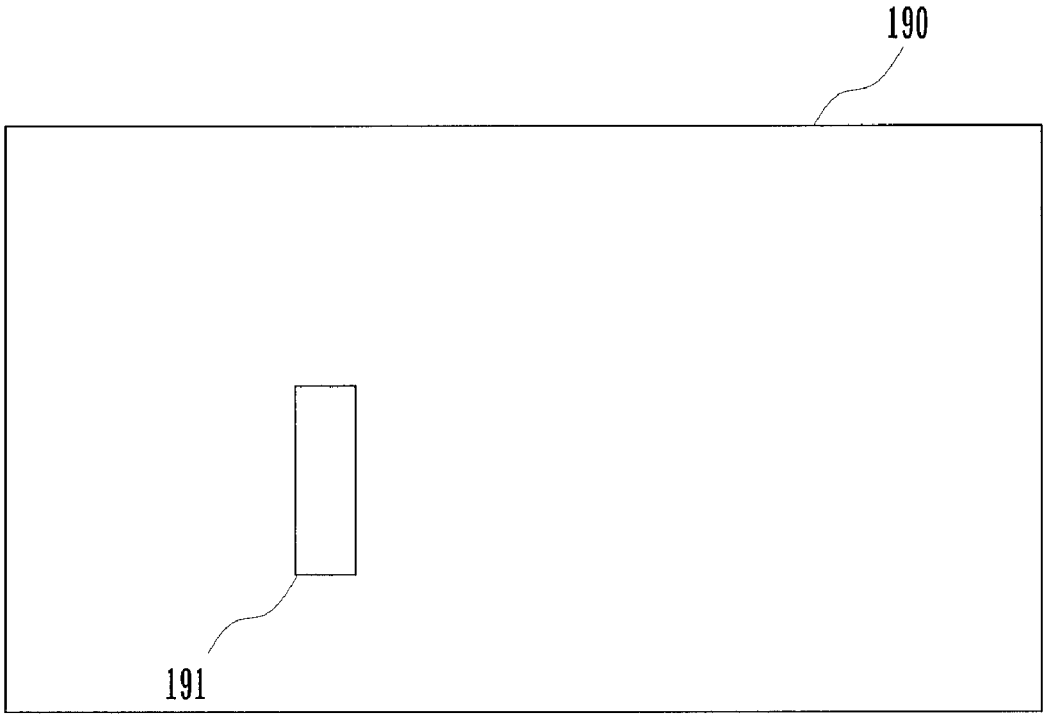
FIG. 13 is a rear view of the front cover of the image recorder.

The front side of the image recorder 100 can be closed by a front cover 190 as shown in FIG. 13. The cover 190 has a recess 191 formed on its back side. The recess 191 is substantially identical in shape with the operating lever 5 and positioned for engagement with this lever in the first angular position. A portion of the cover 190 that surrounds the recess 191 corresponds to the contactor of the present invention.

When the operating lever 5 is in the first angular position, the front cover 190 can close the front side of the image recorder 100, with the recess 191 engaging with the lever 5. When the operating lever 5 is out of this position, a portion of the cover 190 that surrounds the recess 191 prevents the closure of the front side of the recorder 100 by coming into contact with the front side of the lever 5.

The image recorder 100 is designed to operate only while its front side is closed with the front cover 190. This keeps the recorder 100 from operating without the first drawing unit 1 held in the retracted position. As a result, the recorder 100 is prevented from breaking.

The unit drawing mechanism according to the present invention could be embodied similarly in the image recorder 100 even if only the first drawing unit 1 were fitted to the recorder, without the second drawing unit 2 fitted to it. The apparatus of the invention is not limited to the image recorder 100 but may be embodied by various kinds of apparatus each of which requires that a drawing unit be held selectively in it and kept selectively from moving out of it or into it.

It should be considered that the foregoing descriptions of the embodiments are illustrative in all respects and not restrictive. The scope of the present invention is defined by the appended claims, not by the embodiments, and intended to include meanings equivalent to those of the elements of the claims and all modifications in the claims.

What is claimed is:

1. A unit drawing mechanism, comprising:

a drawing unit movable along a movement path between a retracted position in an apparatus and an exposed position outside the apparatus;

a lever supported pivotably on the front side of the drawing unit;

a fixture for locking the drawing unit in the retracted position;

a preventer for preventing the drawing unit from moving from the exposed position;

a linkage linking the lever to the fixture and the preventer; and a lever holder for holding the lever in a first angular position, a second angular position, and a third angular position when the drawing unit is locked by the fixture, positioned on the movement path, and prevented by the preventer from moving from the exposed position, respectively, wherein the linkage transmits to the fixture the turning force created by the lever pivoting from the first angular position to the second angular position and the turning force created by the lever pivoting from the second angular position to the first angular position, and the linkage transmits to the preventer the turning force created by the lever pivoting from the second angular position to the third angular position and the turning force created by the lever pivoting from the third angular position to the second angular position, and wherein, when the drawing unit is in the retracted position, the fixture locks the drawing unit in the retracted position by utilizing the turning force created by the lever pivoting from the second angular position to the first angular position, and the fixture releases the drawing unit by utilizing the turning force created by the lever pivoting from the first angular position to the second angular position.

2. A unit drawing mechanism, comprising:

a drawing unit movable along a movement path between a retracted position in an apparatus and an exposed position outside the apparatus;

a lever supported pivotably on the front side of the drawing unit;

a fixture for locking the drawing unit in the retracted position;

a preventer for preventing the drawing unit from moving from the exposed position;

a linkage linking the lever to the fixture and the preventer; and a lever holder for holding the lever in a first angular position, a second angular position, and a third angular position when the drawing unit is locked by the fixture, positioned on the movement path, and prevented by the preventer from moving from the exposed position, respectively, wherein the linkage transmits to the fixture the turning force created by the lever pivoting from the first angular position to the second angular position and the turning force created by the lever pivoting from the second angular position to the first angular position, and the linkage transmits to the preventer the turning force created by the lever pivoting from the second angular position to the third angular position and the turning force created by the lever pivoting from the third angular position to the second angular position, and further comprising:

a slide rail telescopic along the movement path, the slide rail supporting the drawing unit between the retracted and exposed positions; and the preventer being adapted to prevent the slide rail from contracting.

3. A unit drawing mechanism comprising:

a first drawing unit movable along a movement path between a first retracted position where the whole of the first drawing unit is retracted in an apparatus and a first exposed position where the whole of at least one side of the first drawing unit is exposed on the front side of the apparatus;

a second drawing unit movable perpendicularly to the movement path between a second retracted position where the whole of the second drawing unit is retracted in the first drawing unit and a second exposed position where the second drawing unit is exposed on one side of the first drawing unit;

a lever supported pivotably on the front side of the first drawing unit;

a fixture for locking the first drawing unit in the first retracted position;

a first preventer for preventing the first drawing unit from moving from the first exposed position;

a linkage linking the lever to the fixture and the first preventer;

a second preventer for preventing the second drawing unit from moving from the second retracted position to the second exposed position when the first drawing unit is out of the first exposed position;

the second preventer being adapted to prevent the movement of the second drawing unit from the second retracted position to the second exposed position when the first preventer releases the first drawing unit;

the second preventer being further adapted to release the second drawing unit when the first preventer prevents the movement of the first drawing unit from the first exposed position; and a lever holder for holding the lever in a first angular position, a second angular position, and a third angular position when the first drawing unit is locked by the fixture, positioned on the movement path, and prevented by the first preventer from moving from the first exposed position, respectively.

4. An image recorder comprising:

a paper feed station;

an image forming station;

a delivery station;

a paper feed path leading from the paper feed station through the image forming station to the delivery station;

the image forming station being adapted to form an image on a sheet of paper being fed along the paper feed path; and a unit drawing mechanism as claimed in claim 3;

wherein at least part of the paper feed path leads through each of the drawing units.

5. An image recorder as claimed in claim 4, wherein the image forming station includes a fixing device mounted on the first drawing unit.

6. An image recorder comprising:

a paper feed station;

an image forming station;

a delivery station;

a paper feed path leading from the paper feed station through the image forming station to the delivery station;

the image forming station being adapted to form an image on a sheet of paper being fed along the paper feed path; and a unit drawing mechanism, comprising:

a drawing unit movable along a movement path between a retracted position in an apparatus and an exposed position outside the apparatus;

a lever supported pivotably on the front side of the drawing unit;

a fixture for locking the drawing unit in the retracted position;

a preventer for preventing the drawing unit from moving from the exposed position;

a linkage linking the lever to the fixture and the preventer; and a lever holder for holding the lever in a first angular position, a second angular position, and a third angular position when the drawing unit is locked by the fixture, positioned on the movement path, and prevented by the preventer from moving from the exposed position, respectively, wherein the linkage transmits to the fixture the turning force created by the lever pivoting from the first angular position to the second angular position and the turning force created by the lever pivoting from the second angular position to the first angular position, and the linkage transmits to the preventer the turning force created by the lever pivoting from the second angular position to the third angular position and the turning force created by the lever pivoting from the third angular position to the second angular position, wherein at least part of the paper feed path leads through the drawing unit, and further comprising:

a cover for closing the front side of the image recorder;

the cover including a contactor formed on the inner side thereof for coming into contact with the lever when the lever is out of the first angular position.

7. An image recorder as claimed in claim 4, further comprising:

a cover for closing the front side of the image recorder;

the cover including a contactor formed on the inner side thereof for coming into contact with the lever when the lever is out of the first angular position.

8. An image recorder as claimed in claim 5, further comprising:

a cover for closing the front side of the image recorder;

the cover including a contactor formed on the inner side thereof for coming into contact with the lever when the lever is out of the first angular position.

* * * * *